US010105275B2

(12) United States Patent
Zbinden

(10) Patent No.: US 10,105,275 B2
(45) Date of Patent: Oct. 23, 2018

(54) FLEXIBLE ANKLE-BASED INVERSION DEVICE

(71) Applicant: Adam Jon Zbinden, Tualatin, OR (US)

(72) Inventor: Adam Jon Zbinden, Tualatin, OR (US)

( * ) Notice: Subject to any disclaimer, the term of this patent is extended or adjusted under 35 U.S.C. 154(b) by 181 days.

(21) Appl. No.: 15/249,438

(22) Filed: Aug. 28, 2016

(65) Prior Publication Data

US 2018/0055710 A1 Mar. 1, 2018

(51) Int. Cl.

| | |
|---|---|
| ***A63B 21/00*** | (2006.01) |
| ***A61H 1/00*** | (2006.01) |
| ***A63B 21/068*** | (2006.01) |
| ***A63B 23/02*** | (2006.01) |
| *A63B 23/00* | (2006.01) |
| *A63B 69/00* | (2006.01) |

(52) U.S. Cl.

CPC ..... *A61H 1/006* (2013.01); *A63B 21/068* (2013.01); *A63B 21/4015* (2015.10); *A63B 23/0211* (2013.01); *A63B 23/0233* (2013.01); *A61H 2205/106* (2013.01); *A63B 21/4013* (2015.10); *A63B 2023/006* (2013.01); *A63B 2069/0062* (2013.01); *A63B 2208/0285* (2013.01)

(58) Field of Classification Search

CPC ..... A63B 21/4013; A63B 21/0442; A63B 21/4015; A63B 2208/025; A61H 1/0229; A61H 2203/0493

USPC ..... 482/143, 144

See application file for complete search history.

(56) References Cited

U.S. PATENT DOCUMENTS

| | | | | |
|---|---|---|---|---|
| 4,565,370 | A * | 1/1986 | Christianson | A61H 1/0218 482/144 |
| 5,279,386 | A * | 1/1994 | Cearley | A62B 35/0031 119/907 |
| 8,007,413 | B1 * | 8/2011 | Wu | A63B 21/068 482/131 |
| 8,038,584 | B1 * | 10/2011 | Pruessner | A61H 1/02 482/143 |
| 8,845,568 | B2 * | 9/2014 | Clark | A61F 5/3776 602/32 |
| 8,858,408 | B2 * | 10/2014 | DeMeo | A63B 21/00185 482/131 |
| 8,979,716 | B1 * | 3/2015 | Rawlins | A63B 21/0442 482/129 |
| 9,259,605 | B1 * | 2/2016 | Puig | A63B 7/00 |
| 9,854,898 | B2 * | 1/2018 | Whitley | A61G 7/1015 |
| 9,895,566 | B2 * | 2/2018 | Zbinden | A63B 21/00043 |
| 2014/0073496 | A1 * | 3/2014 | Bannerman | A63B 21/0442 482/139 |
| 2014/0155233 | A1 * | 6/2014 | Latronica | D04G 5/00 482/124 |

(Continued)

*Primary Examiner* — Joshua T Kennedy

(57) ABSTRACT

A device for performing ankle-based inversion postures. A primary loop in combination with retainer loops forms an ankle enclosure which contracts in response to the application of load tension. An expansion of the ankle enclosure occurs when an upward force is applied to it with a simultaneous application of downward force on the release loop. A linkage between the lowest points on the primary and release loops transfers applied tension between these components to ensure a smooth expansion action of the ankle enclosure. A connector loop forms a topmost location on the device and is the junction point for the mounting loop which anchors the device to support structures for its use.

3 Claims, 4 Drawing Sheets

(56) References Cited

U.S. PATENT DOCUMENTS

2016/0023051 A1* 1/2016 Lauener ..... A61H 1/0229
482/143

* cited by examiner

FLEXIBLE ANKLE-BASED INVERSION DEVICE

BACKGROUND OF THE INVENTION

In recent decades, inversion therapy has become a popular and well-researched method for achieving musculoskeletal decompression. Using the lower-leg as the point of suspension enables nearly every joint in the human body to be in a state of traction. Devices for achieving this physical posture have been available for several decades, marketed under the popular name of "gravity boots". These conventional designs use rigid metal or plastic shells which clamp or cinch around the user's shins, and a hook which is secured to the front of the shell allows for attachment to a horizontal supporting bar structure.

The device described in this document provides an alternative method for performing this exercise, with design advantages resulting in improved safety and comfort.

SUMMARY OF THE INVENTION

The device described in this document tightens and secures around the user's lower leg in direct proportion to the magnitude of applied tension. In practice, this means that the device is in a state of maximum closure when the user is fully inverted. It is therefore impossible to slip out of the device while using it.

The materials used to construct the device are soft and flexible and conform to the shape of the user's leg to distribute pressure as evenly as possible and therefor minimize discomfort. Traditional rigid-shell designs place concentrated pressure on the front of the user's lower shin region during use, and other pressure points can exist due to the metal hooks or buckles required by conventional designs.

The design shown in this document is collapsible for storage and transport and can easily fit into a small gym bag. Traditional gravity boots can be oversized and heavy and are less portable.

The additional weight attached to the ankles when using conventional gravity boots creates a significant burden when raising the feet to the bar elevation to attach the hooks. This burden is caused by the natural moment which occurs when the feet are extended outward in front of the body and pivoted about the axis of the hips and lower abdomen. The gravitational loading which is caused by the weight of the attached conventional gravity boots is multiplied by the length of the entire leg, resulting in an additional force which must be overcome by muscular effort. The design of the device described in this document eliminates this unnecessary burden, as no extra weight is attached to the ankles when entering or exiting the inverted posture.

While the device described enables decompression of the spine and joints, said device can also be used as a fitness tool. Exercises which can be performed while in the inverted posture include:

1) Sit-ups
2) Reverse crunches and back extensions
3) Reverse squats, an exercise functionally equivalent to a full glute-ham raise

DETAILED DESCRIPTION OF THE INVENTION

Figure 1:
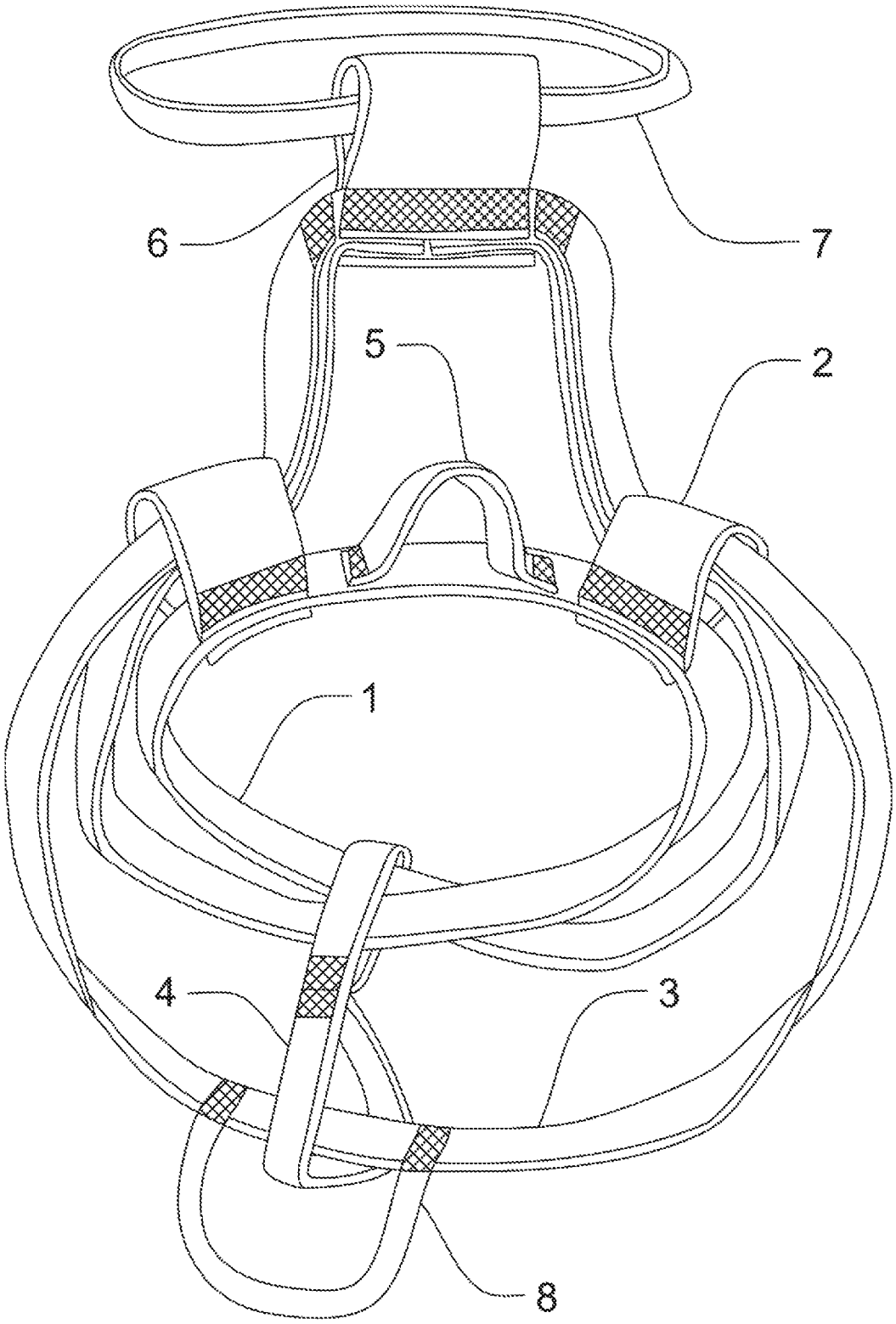
FIG. 1 is a depiction of the device, where the primary loop (1), in combination with the retainer loops (2), securely holds the ankles during use. The release loop (3) enables the primary loop (1) to expand when downward force is applied to the bottom of (3), based on the linkage loop (4) which provides a material connection and tension-transfer mechanism between (3) and (1). The connector loop (6) terminates the ends of the primary loop (1) at the top of the device and links to the mounting loop (7). Alternative embodiments may include a release loop grip (8) for manipulating the release loop (3) or a loop (5) for holding the ankle-enclosure of the primary loop (1) in an expanded state.

The device disclosed herein is a minimum embodiment required for performing all possible exercises enabled by its structure. Alternative embodiments may incorporate obvious modifications to suit user preferences, such as: padding around the ankle region, fabric sheaths over material surfaces, and other embellishments commonly used in the art field of the present invention.

LIST OF DEVICE COMPONENTS CORRESPONDING TO DRAWING REFERENCE NUMERALS

The primary loop is shown with 1, the retainer loop is shown with 2 (and, by implication, the pair of retainer loops is thus identified), the release loop is shown with 3, the material linkage between the release loop bottom and the bottom location on the primary loop is shown with 4, the optional ankle enclosure grip surface is shown with 5, the connector loop is shown with 6, the mounting loop is shown with 7, and the optional release loop grip surface is shown with 8.

Figure 2:
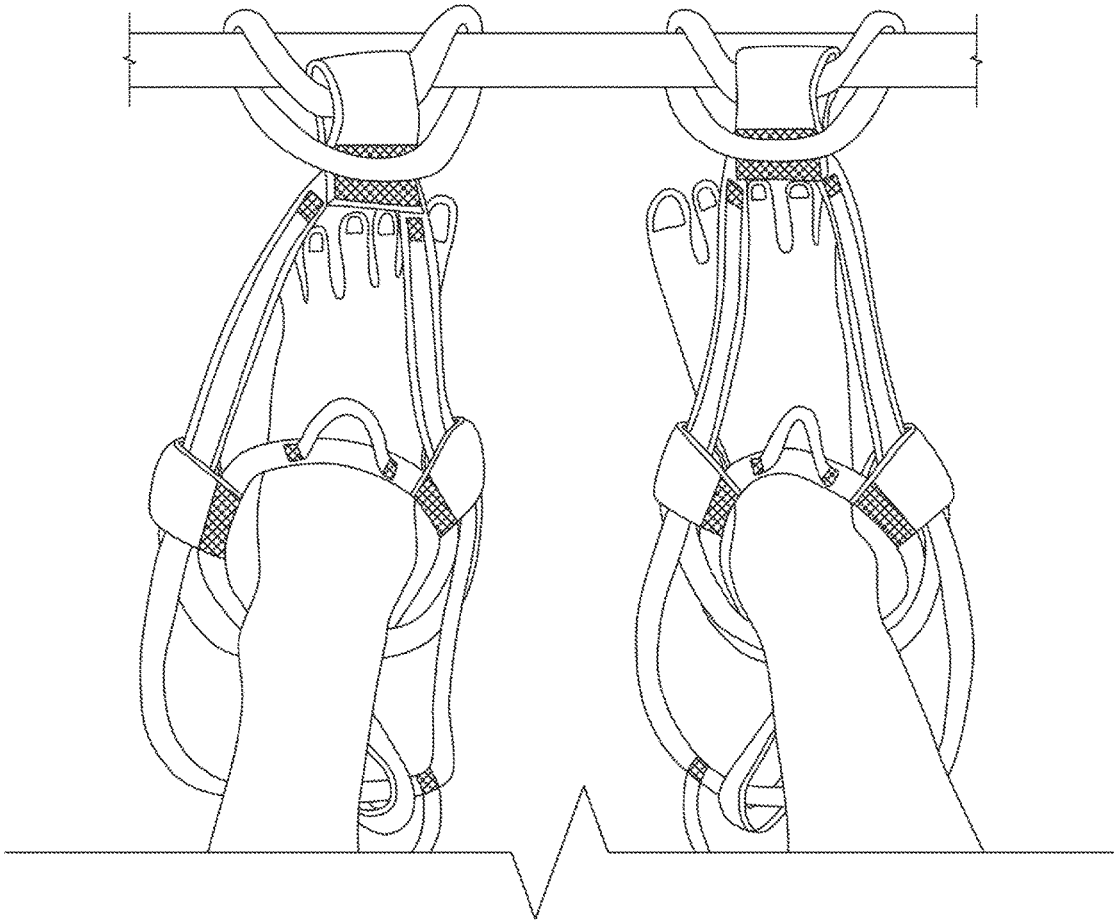
FIG. 2 is an illustration of a pair of devices surrounding a user's ankles and mounted to a bar support structure, with exaggerated interface boundaries to demonstrate the overall spatial relationship between a user, a pair of devices, and the mounting bar.

Safe Method of Operation:

Entry:

1) The user places the mounting loop of one device over the mounting bar and threads the rest of the device through it to encircle the bar within the mounting loop, as shown in FIG. 2. The user repeats this procedure to mount the second device. The devices should be oriented so that the bowed region of the retainer loops face away from the user and spaced to a comfortable distance (slightly less than shoulder width).
2) The user expands the ankle enclosure of each primary loop to its maximum circumference. The user then grips the horizontal support bar on the outside of each device and holds the ankle enclosure open using the thumbs, if necessary.
3) The user lifts both feet upward to the bar and inserts each foot through the ankle enclosure of each device, such that it loosely surrounds the lower shin region, above the ankle.
4) The user moves both feet downward to tension and close the primary loops of each device around the ankles. This secures the connection between the device and the user.

5) The user releases the manual grip on the support bar and leans back into the inverted position.

Exit:

1) The user raises their torso upward until the bar is within reach, to establish a secure hold on the bar with both hands, and then uses their upper body to support a fraction of their weight.
2) The user raises a foot upward and simultaneously exerts downward tension on the bottom of the release loop of its surrounding device, using an opposite foot. This process expands and de-tensions the ankle enclosure of the primary loop.
3) The user withdraws their leg and foot from the inversion device which has been opened using the method described in the previous step.
4) The user repeats Steps 2 & 3 for their leg which has not been released from its inversion device.
5) The user lowers both feet to the ground and establishes secure footing and balance before releasing their hand grip connection to the auxiliary support bar.

Physical Action Mechanism of the Device:

The distance between the attachment points of the retainer loops (2) on the primary loop (1) determines the minimum circumference of the ankle enclosure formed by the primary loop (1), as the fixed locations of the retainer loops (2) create static physical limits on the contraction of (1). The distance from the retainer loops (2) to the ends of the primary loop (1) at the top location on the device (6) determines the maximum circumference of the ankle enclosure formed by the primary loop (1), as said distance comprises the range of the slack-adjusting extensions of the primary loop (1).

The release loop (3) enables force application to the top location on the device (6), where load tension is transferred from the device to the mounting structure via the mounting loop (7). Enveloping the release loop (3) within the retainer loops (2) provides leverage for expanding the ankle enclosure of the primary loop (1) through an upward force application to the ankle-enclosure of (1) and a simultaneous counter-tension application to the bottom of the release loop (3). The material linkage (4) ensures a smooth expansion action of the ankle enclosure of the primary loop (1) during this process.

Figure 3:
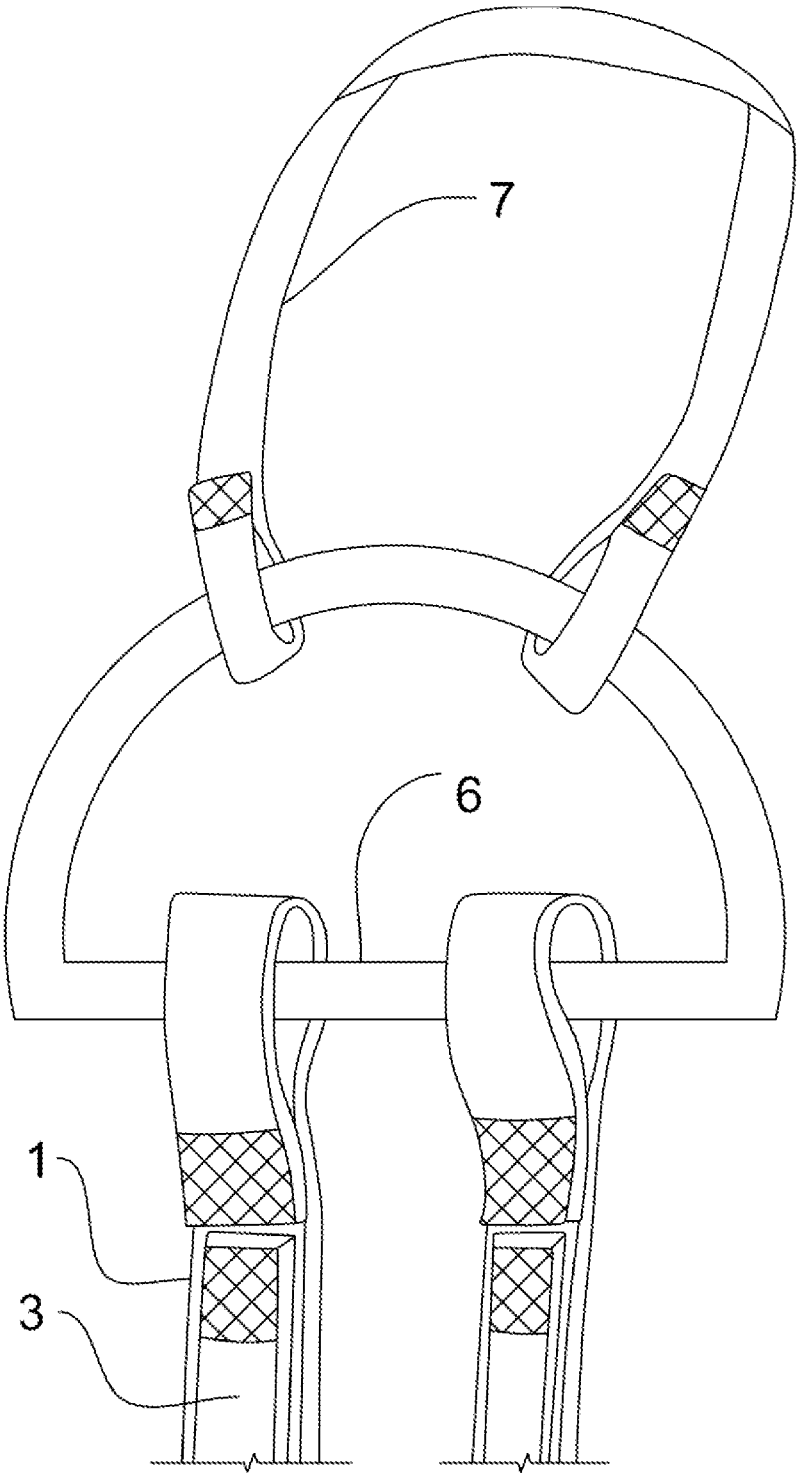
FIG. 3 is a depiction of the top location on the device, where the connector loop (6) is comprised of hardware instead of webbing.
Figure 4:
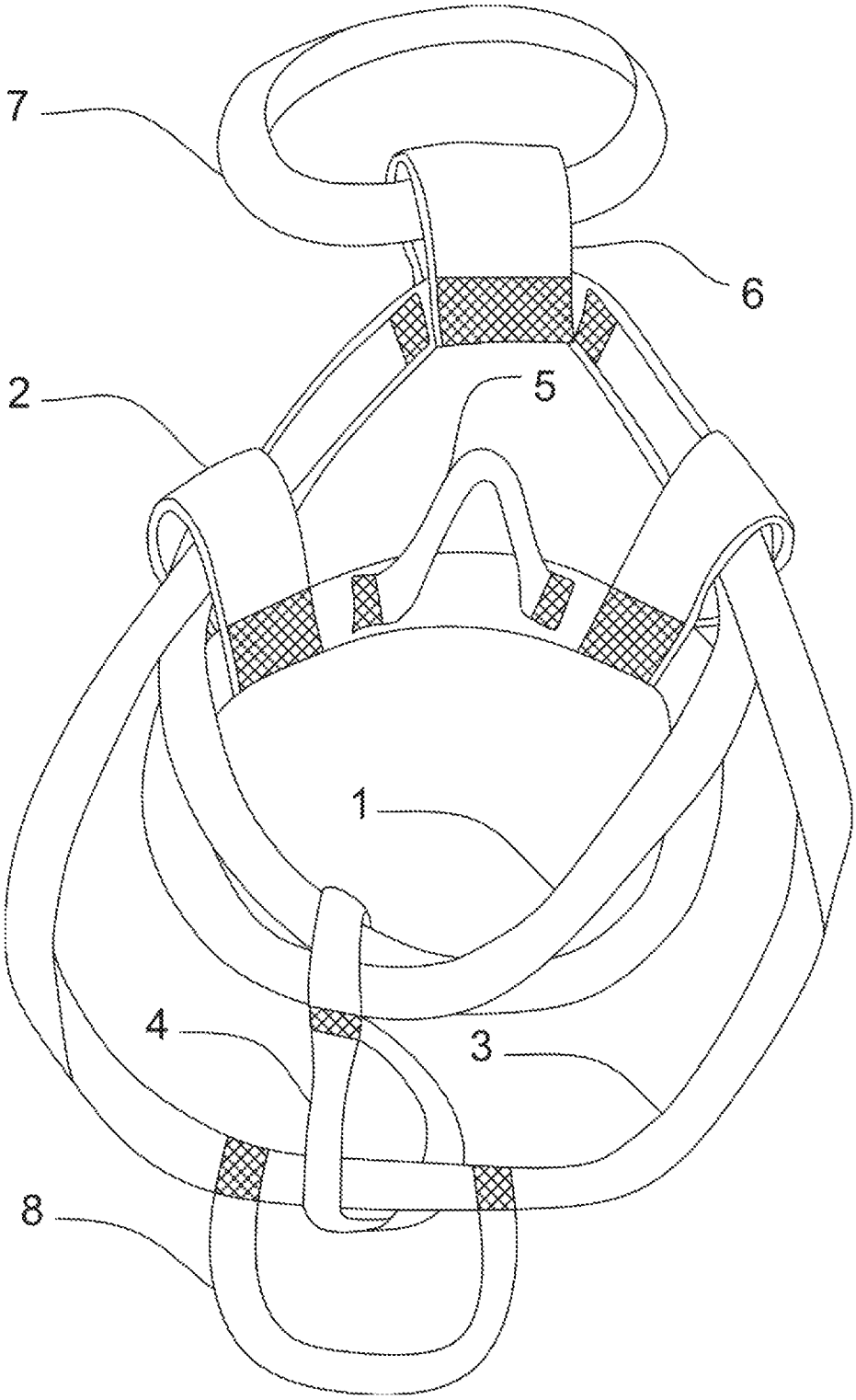
FIG. 4 is a front view of the device.

A pair of loops can be formed at and from the open ends of the slack-adjusting extensions of the primary loop (1). This is depicted in FIG. 3. In combination, the loops which are thereby attached to the ends of the slack-adjusting extensions of the primary loop (1) are topologically and functionally equivalent to the connector loop (6) of claim 1. The connector loop (6) which is fashioned in the manner described above can then be linked directly to the mounting loop (7), using a connection method which is identical to what is shown in FIGS. 1, 2 & 4.

The device can be assembled, based on the figures and claims provided, using standard best practices when sewing webbing for load-bearing applications.

The invention claimed is:

1. A device for suspending a human user by the ankles in an inverted posture, comprising:

a) a primary loop comprised of a webbing coil which forms two concentric rings where a first ring is closed to create an ankle enclosure of adjustable circumference and a second ring has open ends which extend to a top location on the device to create a pair of slack-adjusting extensions while a transition boundary between the ankle enclosure and the slack-adjusting extensions occurs at a bottom location on the primary loop;
b) a pair of retainer loops which attach symmetrically to the ankle enclosure of the primary loop and which the slack-adjusting extensions of the primary loop pass through such that the retainer loops envelop and are movable along the slack-adjusting extensions;
c) a connector loop which attaches to and terminates the slack-adjusting extensions of the primary loop at the top location on the device and which forms a mounting loop attachment point;
d) a mounting loop which connects at the mounting loop attachment point;
e) a release loop which attaches to the top location on the device and passes through the retainer loops while a release loop bottom extends lower than the bottom location on the primary loop; and
f) a material linkage between the release loop bottom and the bottom location on the primary loop where the linkage length is determined such that the linkage is configured to be taut when the ankle enclosure of the primary loop is fully contracted around a user's ankle.

2. The device of claim 1, wherein an auxiliary grip surface is attached to the ankle enclosure of the primary loop, between the retainer loops.

3. The device of claim 1, wherein an auxiliary grip surface is attached to the release loop bottom.

* * * * *